United States Patent [19]

Edler et al.

[11] 4,205,935

[45] Jun. 3, 1980

[54] CONTINUOUS HEATING FURNACE FOR THE HEAT TREATMENT OF SMALL PARTS

[75] Inventors: Karl-Heinz Edler; Karl H. Burmeister, both of Kleve, Fed. Rep. of Germany

[73] Assignee: Ipsen Industries International Gesellschaft mit beschränkter Haftung, Kleve, Fed. Rep. of Germany

[21] Appl. No.: 897,409

[22] Filed: Apr. 18, 1978

[30] Foreign Application Priority Data

Feb. 2, 1978 [DE] Fed. Rep. of Germany ..... 2804338

[51] Int. Cl.[2] ..... F27D 3/06

[52] U.S. Cl. ..... 414/152; 266/130; 414/153; 414/156; 414/421; 432/122; 432/126

[58] Field of Search ..... 414/150, 152, 153, 156, 414/421; 432/121, 122, 126; 266/130

[56] References Cited

U.S. PATENT DOCUMENTS

| | | | |
|---|---|---|---|
| 1,508,369 | 5/1973 | Wunning | 414/150 |
| 2,084,002 | 6/1937 | Peterson | 432/126 X |
| 4,033,715 | 7/1977 | Beck | 432/121 X |

*Primary Examiner*—Robert G. Sheridan
*Attorney, Agent, or Firm*—Martin A. Farber

[57] ABSTRACT

A continuous heating or pusher-type furnace for the heat treatment of small parts, by which in a closed furnace chamber glide tracks are provided for the intermittent feeding of basket cars in a row between a loading station and a discharge station which is connected gas-tight to the furnace chamber, in the vicinity of which stations there is arranged respectively a reversing device for the translation of the individual baskets from one glide track to the other glide track, whereby the filled baskets automatically can be inserted into the discharge station, and can be emptied by a tipping device with a connecting gravity chute into a quenching bath. The glide tracks with the loading station and the discharging station lie on one plane and at least two glide tracks are provided for the transportation of the filled baskets, the two glide tracks being symmetrically arranged relative to a glide track provided for the return transportation of the emptied baskets.

8 Claims, 8 Drawing Figures

CONTINUOUS HEATING FURNACE FOR THE HEAT TREATMENT OF SMALL PARTS

The present invention relates to a continuous heating or pusher-type furnace for the heat treatment of small parts, by which in a closed furnace chamber glide tracks are provided for the intermittent feeding of basket cars in a row between a loading station and a discharge station which is connected gas-tight to the furnace chamber, in the vicinity of which stations there is arranged respectively a reversing device for the translation of the individual baskets from one glide track to the other glide track, whereby the filled baskets automatically can be inserted into the discharge station and can be emptied by means of a tipping device with a connecting gravity chute into a quenching bath.

A continuous furnace with these features is known from German Pat. 1 508 369, by which there are provided two guide tracks which are arranged one above the other, which requires the re-routing or transfer of the baskets from one plane to the other. This re-routing however is susceptible to trouble and breakdown and comparatively time consuming, as well as technically costly, which particularly can then cause disadvantages in the productive capacity of the furnace, when with respect to the thermal loadability, parts built-in the furnace have already reached a maximum furnace temperature, and consequently an increase in production is no longer possible for example with carburizing and carbonitriding, respectively, by increasing the furnace temperature. An increase in the productive capacity may then be obtained only by means of a lengthening of the guide tracks.

Further, from U.S. Pat. No. 1,738,039 a one-sided annealing furnace which is closed on one side is known, likewise with two glide tracks, the tracks being arranged in one plane and separated from each other by a wall. Dependent upon the one-sided closed type of construction and the divided furnace chamber, already even the existing thermal relationships or conditions with this known furnace do not offer favorable conditions in order to achieve first-rate or outstanding metallurgical results with a cost saving manner of operation.

The present invention is based on the task and object of constructing, with the simplest possible and economical manner, a continuous furnace of the introductory mentioned type such that an increase of the production capacity is achieved with simultaneously improved thermal conditions.

It is a further object in accordance with the present invention to aid the solution of the above-mentioned object in the manner that the glide tracks (e.g., 15, 16, 17) with the loading station (11) and the discharging station (12) lie on one plane and that at least two glide tracks (15, 16) are provided for the transportation of the filled baskets (22), which two glide tracks are symmetrically arranged relative to a glide track (17) which is provided for the return transportation of the emptied baskets (22).

In this manner a higher charge through-put is attained without being required to reduce the traversal time for the individual glide tracks and consequently the heat treatment time, which otherwise necessarily would lead to a corresponding increase in the furnace temperature. Simultaneously on the basis of the symmetrical arrangement of the glide tracks, the existing furnace space may be best utilized, which leads to an extremely uniform heating of the entire charge in connection with the forced circulation of the furnace atmosphere.

According to a preferred proposal of the invention, for the loading and discharge capacity of the furnace it is advantageous when the charging station (11) and the discharging station (12) are aligned with the guide track (17) which is provided for the return transportation of the empty basket cars (22).

In order to further increase the discharge speed, the tipping device (38) preferably has one pivot axis or axle (42) which extends parallel to the longitudinal axis of the glide tracks.

A safe or secure guiding of the baskets into the discharge station thus can be achieved advantageously in that each basket (22) is secured to a pallet-like base support (23) and that the tipping device (38) is provided with lateral guide rails (41) in which the base support (23) can be inserted.

Preferably the discharge station (12) is separated from the furnace chamber (13) by a door, whereby in the furnace chamber itself an improved forced circulation of the atmosphere may be achieved, and an influence on the furnace atmosphere by the vapors of the quenching medium is avoided.

Finally according to a further advantageous proposal in accordance with the invention the reversing or re-routing devices (30-32) comprise two piston-cylinder units, the stroke directions of which run perpendicularly to the direction of movement of the baskets (22) and the control of which occurs selectively in dependency on the cycle succession of the empty baskets (22) which emerge from the discharge station (12).

With the above and other objects and advantages in view, the present invention will become more clearly understood in connection with the following detailed description of preferred embodiments, when considered with the accompanying drawings, of which:

Figure 1:
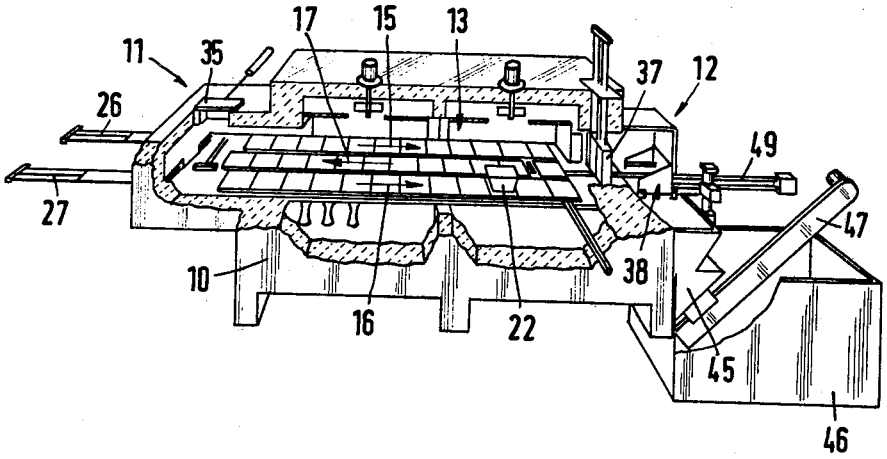
FIG. 1 is a perspective view partially broken away of a furnace in accordance with the present invention.

The furnace which is constructed in the conventional manner of a fireproof material has a housing 10, in which a furnace chamber 13 extends as a tunnel between a loading or charging station 11 and a discharge station 12. The furnace chamber 13 comprises a plurality of heating zones and in conventional manner is heated by heating elements 14 which laterally run through the furnace chamber 13.

Three glide or slide tracks 15, 16 and 17 which are made of a ceramic material and which lie adjacent one another are formed in the furnace chamber 13, of which the two outermost guide tracks 16, 15 are provided for feeding the charge to the discharge station 12. The glide tracks are enclosed or surrounded by a muffle 18 (FIG.

Figure 6:
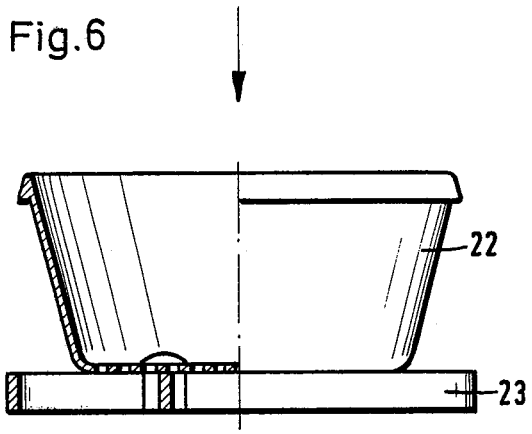
FIG. 6 is an enlarged view partially in axial section of a transportation car.
Figure 7:
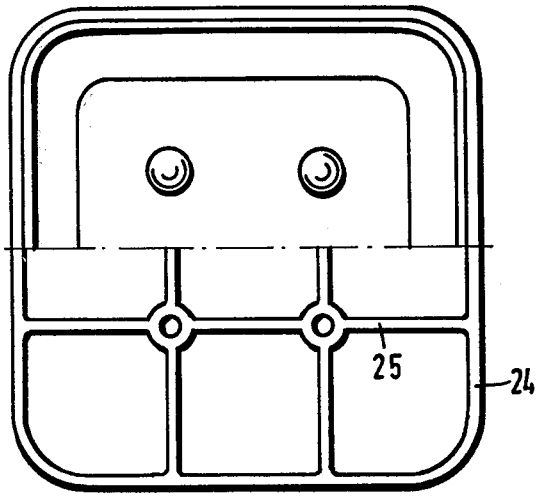
FIG. 7 is a view in the direction of the arrow in FIG. 6 and partly broken away.

4) made of a fireproof material for protection of the charge against direct radiation, in the bottom surface of which muffle in the range of the two outer guide tracks 15, 16 and in its cover surface above the center guide track 17 there are formed recesses 19, 20, respectively. In the range of the upper recesses 20 two fans or ventilators 21 are provided which insure a circulation of the entire furnace atmosphere in the manner that the gas which is heated by the heating elements 14 is sucked via the lower recesses 19 into the muffle 18 and after the entrance is pushed again to the heating elements 14 through the upper recesses 20. The charge is transported through the furnace chamber 13 preferably with the aid of rectangularly shaped baskets or cars 22 (FIG. 6), which are produced of perforated plate or sheet metal and their bottom surfaces in an advantageous manner are smaller than the opening of the baskets or cars 22. Each basket 22 is rigidly riveted to a pallet-like base support 23 serving as a framework or grating, which base support likewise is rectangularly shaped and has a cast frame 24, which frame is reinforced by stays or ribs 25. The supports 23 are arranged on the glide tracks such that their frames 24 abut against one another on the face sides, and consequently on each glide track there arises a continuous progressing row. The baskets 23 are purposefully held in their dimensions such that they do not touch each other.

The feeding of the base support 23 with the baskets 22 which are arranged thereon in the direction of the discharge station 12 takes place with the help of a feeding device which comprises two pneumatically driven pushing cylinders 26, 27, the feeding device being arranged on the front side of the furnace at which side the loading station 11 is located. The pushing cylinders 26, 27, whose direction of stroke runs essentially in the elongated center axis of the related guide tracks 15, 16, respectively, are provided on their free ends with a thrust piece 28, the latter acting during the feeding on the frame of the then front base support 23 of the guide tracks 15, 16. The end side translation of the supports 23 and of the baskets 22 from one glide track to the other takes place with the aid of three reversing or re-routing devices 30, 31 and 32, which each comprise one piston-cylinder unit and are arranged laterally on the furnace housing 10 such that they stand pair-wise opposite to each other and their direction of stroke runs substantially perpendicularly to the glide tracks, whereby the reversing device 30 alternately shifts toward the right or toward the left. The operation of the reversing devices, instead of by piston-cylinder units, can take place by pushing or driving chains, toothed or gear racks and the like. The free ends of their piston rods are each provided with one thrust piece 33 as with the feeding device, the thrust piece acting laterally on the frame 24 during the translation of the supports 23.

Figure 2:
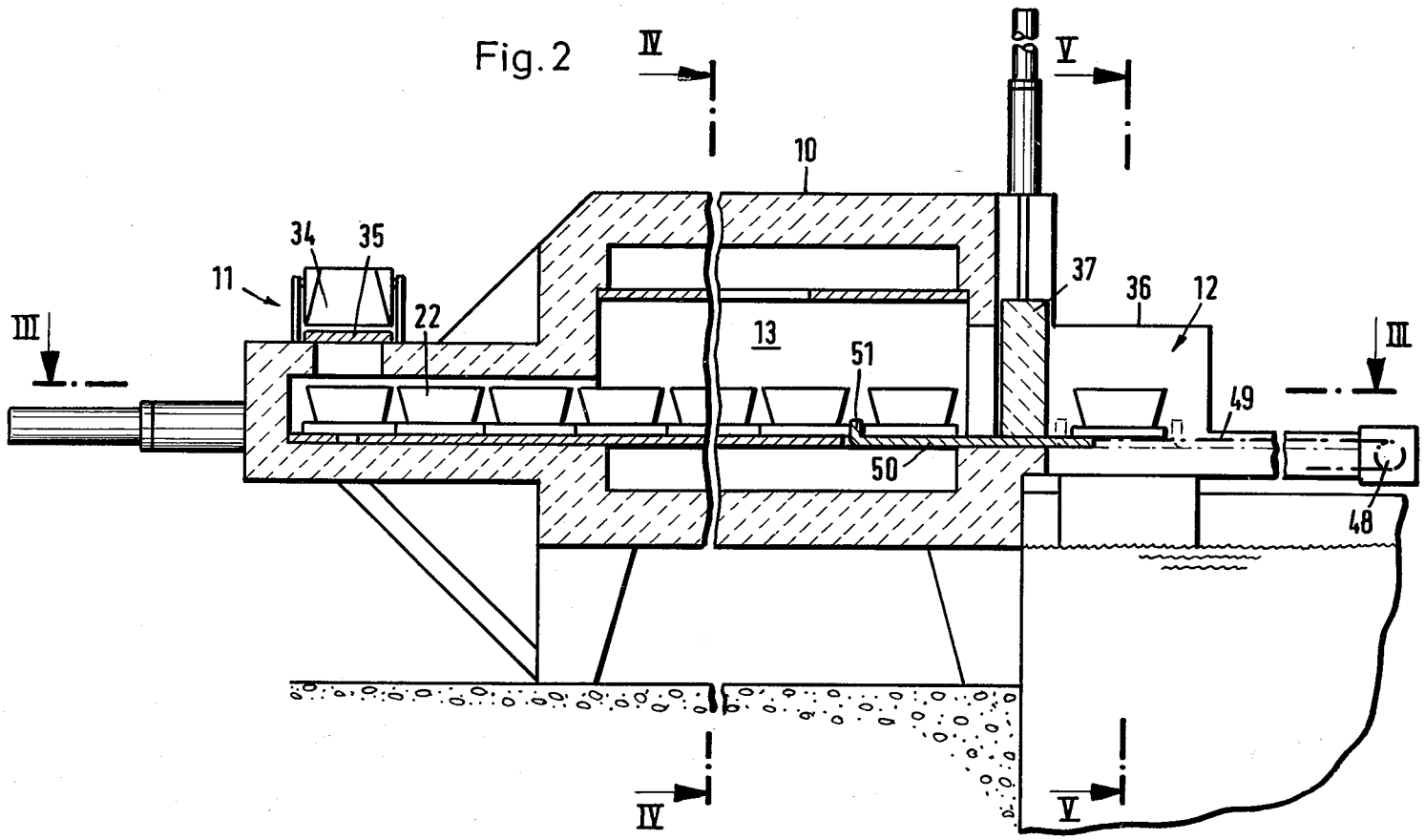
FIG. 2 is a side view of a modified embodiment of the furnace in axial section and partly broken away.
Figure 3:
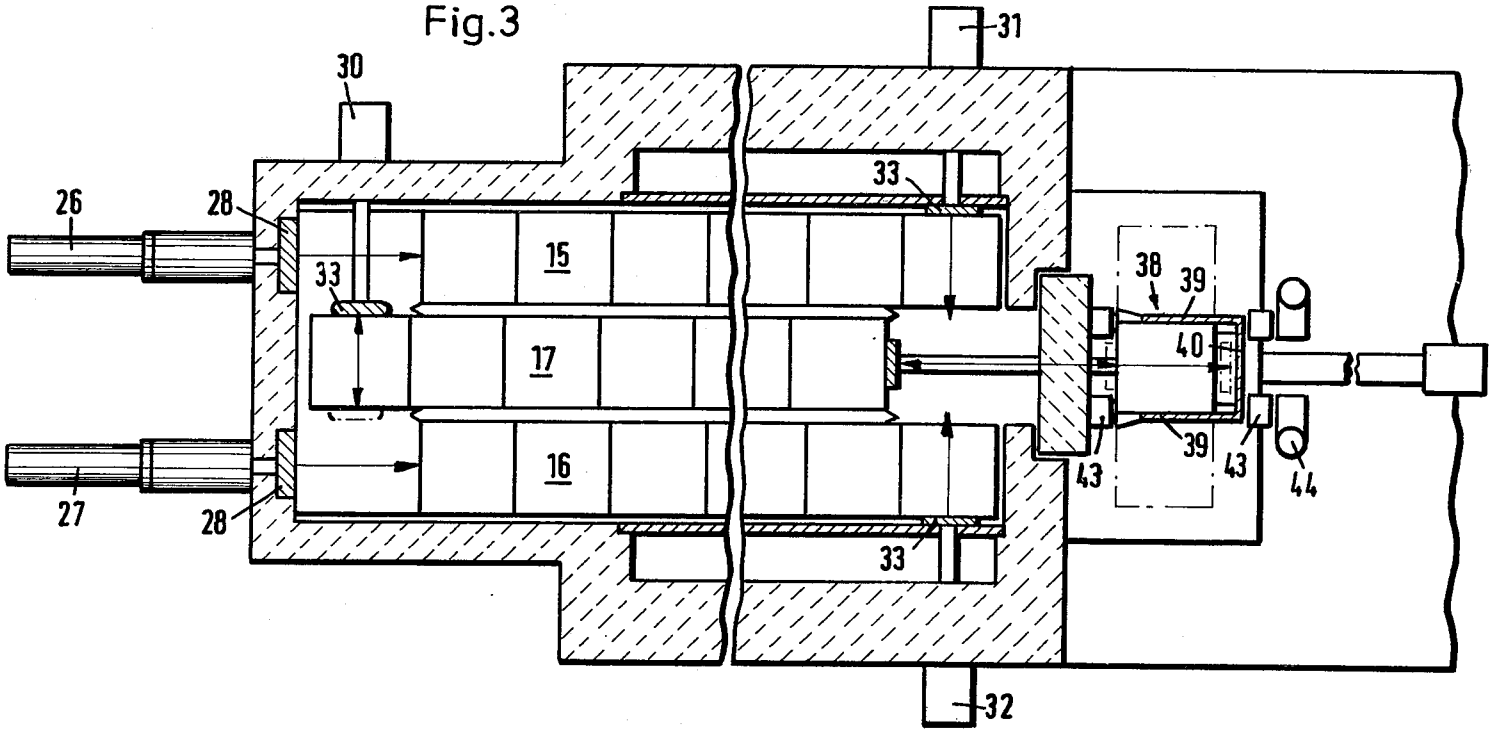
FIG. 3 is a section taken along the lines III—III of FIG. 2.
Figure 4:
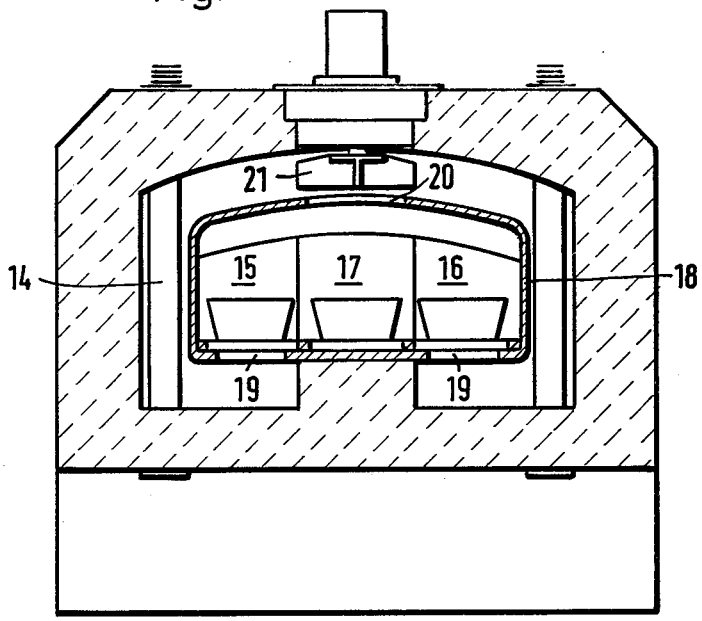
FIG. 4 is a section taken along the lines IV—IV in FIG. 2.

The loading station 11 substantially comprises a loading ramp 34, which is arranged at the end of the furnace above the center guide track 17 at the height of the last holding location of the baskets 22, and is separated or detached from the furnace chamber 13 by means of a pneumatically actuatable loading door 35. The empty basket thereunder which remains in the furnace is filled with the parts to be treated from above through the opening (FIG. 2) in the furnace housing 10. The discharge station 12 is accommodated in a housing part 36 gas tightly connecting onto the furnace chamber 13, which housing part 36 thus protects the heat treated parts during the discharge from the furnace in the hot condition from coming into contact with the oxygen of the air. The housing part 36 additionally is closed off from the actual furnace chamber 13 by means of a pneumatically actuatable inner door 37.

In the housing part 36 there is provided a tipping device 38 in the shape of a box-like holder, which holder lies in the extension of the axis of the center guide track 17 and is composed of two side walls 39 and one rear wall 40, with the spacing of the side walls 39 substantially corresponding to the width of the base support 23 of the baskets 22. The holder 38 is open toward the guide track 17 and downwardly, and includes guide rails 41 (preferably comprising U-shaped angle members) on the inside on the side walls 39 in the vicinity of the bottom opening. The guide rails 41 are aligned and face each other with their open sides and are dimensioned such that the base support 23 with its frame 24 can be inserted.

Figure 5:
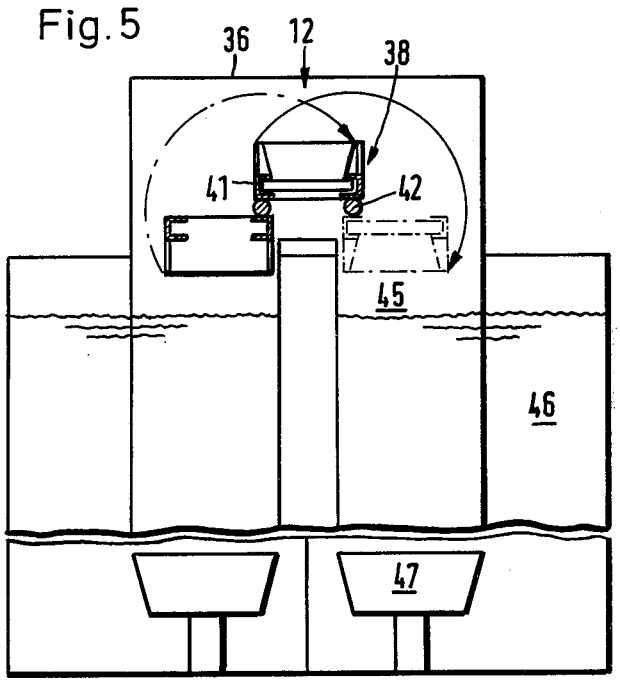
FIG. 5 is a section along the lines V—V in FIG. 3.

The tipping device 38 is rotatable about an axle which extends parallel to the center axis of the guide track 17 and is formed by a shaft 42 which is connected via a bearing or mounting 43 with one of the side walls 39 of the holder and is drivable by means of a suitable drive 44. The bearing 43 has its fixed or reference point on the housing part 36. The shaft 42 to the contrary is rigidly connected with one of the side walls 39 and forms a rigid connection for and with the drive 44, thus turning with the basket or car by 180° as illustrated in dot dashed lines in FIG. 5. For discharge, the holder together with the base support with the basket 22, which base support is fixed in the guide rails 41, are rotated by 180° about the shaft 42. In the housing part 36 underneath the tipping device 38 for this purpose a reception shaft 45 is provided which stands in connection with a quenching tank 46, from which the parts, for example, by means of a bucket conveyor 47 again can be delivered or carried out.

The tipping device 38 can also be formed without large expense in the manner such that parallel to the first shaft 42 where is provided an additional shaft with a tipping device, the latter tipping device facilitating a pivot movement by 180° opposite to the first movement. In this case it would also be advantageous to subdivide the quenching tank and to fill it with two different media, for example water and oil, so that the charge can be selectively emptied into one or the other quenching bath, as this is provided in the embodiment illustrated in FIGS. 2–5. In this respect also another holder is provided for baskets or cars 22 which do not have pallet-shaped base supports. The holder has the shape of a frame or mounting made of L-shaped side parts according to FIG. 5.

The discharge station 12 is fed with the aid of a pushing or driving chain 49 which is driven by a chain wheel 48, which chain 49 for this purpose is coupled at the upper run to a connecting rod 50, on the free end of which there is formed an upwardly directed finger 51. In its starting position the finger 51 acts on that face side of a frame of a s ıpport 23 which faces away from the discharge station, the support 23 previously having been pushed from one of the two outer glide tracks 15, 16 by the reversing device 31, 32 into this starting position, and the finger 51 pulls this in up to engagement in the tipping device 38. When the basket 22 is tipped over, the rod 50 can move into the illustrated end position (in FIG. 2 the right hand-most dot-dashed illustrated position) in which the finger 51 abuts or contacts on the opposite or forward front surface of the same frame of the support 23. After the discharging operation this frame is pushed with its emptied basket 22 by the forward movement of the driving chain 49 out from the tipping device 38 until it is in a position on the center guide track 17 with the track being shifted or displaced toward the left by one holding position in the drawing and in which the finger 51 again occupies its starting position. In this manner simultaneously the associated row of the emptied baskets 22 are displaced toward the left on the center glide track 17 by the length of one base support 23, whereby the last basket 22 in the row assumes and occupies its holding position underneath the loading ramp 34.

Figure 8:
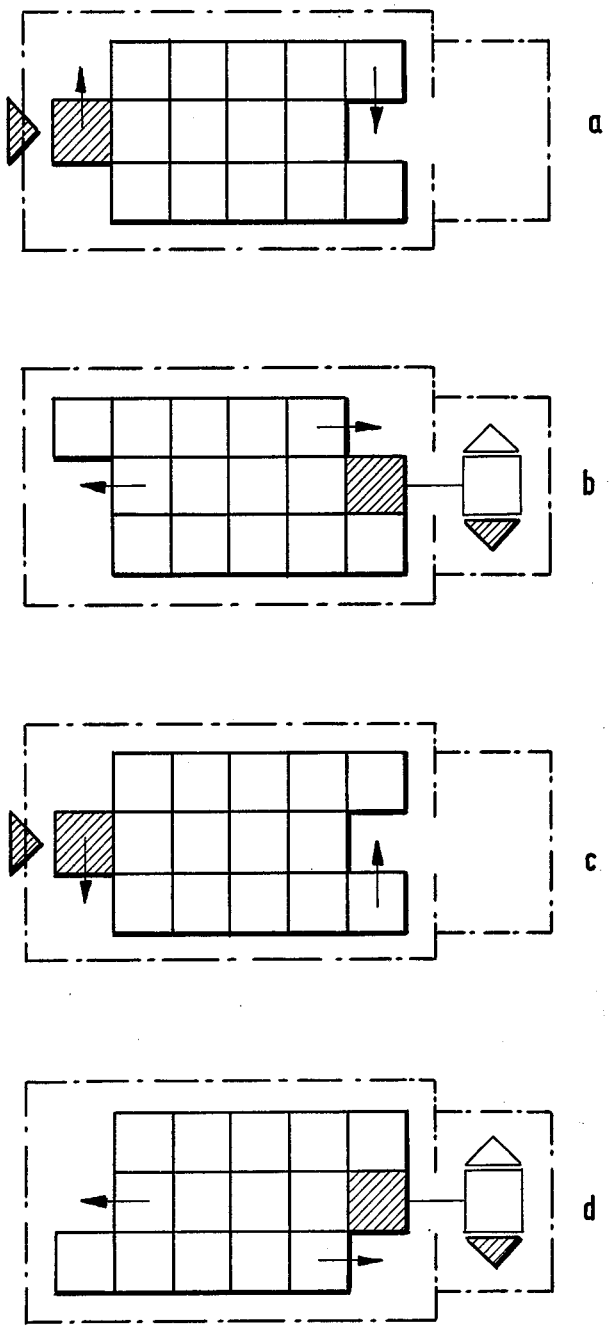
FIGS. 8*a, b, c* and *d* are block diagrams of different cycle successions of the completely mechanized operating course of the furnace according to FIG. 1.

The completely mechanized course of operation of the furnace is schematically illustrated in block form in FIG. 8, which shows working cycles comprising the steps of charging (a), discharging (b), charging (c), and discharging (d). Between each cycle there is a working cycle in which the baskets are shifted into the positions indicated with the arrows, whereby the feeding takes place alternately on the two outer glide tracks 15, 16, and respectively, each coincide with an oppositely directed displacement of the emptied baskets on the center guide track 17.

According to a further embodiment of the invention, however not described in more detail, the discharge station 12 instead of being aligned with the center guide tracks 17 also can be aligned with one of the outer two guide tracks 15, 16. In this case for example the following working cycles would be possible:

(I) charging/discharging
1 cycle
1 cycle
1 cycle
charging/discharging
1 cycle
1 cycle
1 cycle
charging/discharging
etc.

(II) charging/discharging
1 cycle
1 cycle
charging
1 cycle
discharging
1 cycle
1 cycle
charging/discharging
etc.

Finally also a further modification of the previously described embodiment is conceivable by which for the feeding of the filled baskets totally three guide tracks are provided and for the return transportation of the emptied baskets two guide tracks are provided, which are alternately arranged. In this case it would be advantageous to equip the furnace with two charging and discharging stations each, which are then to be aligned with the glide tracks provided for the return transportation of the emptied baskets.

While we have disclosed several embodiments of the invention it is to be understood that these embodiments are given by example only and not in a limiting sense.

We claim:

1. A continuous heating furnace for the heat treatment of small parts adapted to be placed in baskets and constituting filled baskets, comprising a furnace defining a closed furnace chamber and having a loading station and a discharging station connected gas-tight to said furnace chamber, glide tracks adapted for the intermittent feeding of the baskets in a row between the loading station and the discharging station, reversing means disposed respectively in the vicinity of said loading and discharging stations for the translation of individual baskets from one of the glide tracks to other of the glide tracks, respectively.

tipping means including a connecting gravity chute for emptying filled baskets into a quenching bath, and said glide tracks with said loading station and said discharging station are disposed on one plane, and said glide tracks comprising at least two track means for the transportation of the filled baskets and another track means for the return transportation of emptied baskets, said two track means being symmetrically arranged relative to said another track means.

2. The furnace as set forth in claim 1, wherein said loading station and said discharging station are aligned with said another track means, the latter for the return transportation of the emptied baskets.

3. The furnace as set forth in claim 1, wherein said tipping means has a pivot shaft extending parallel to the longitudinal axes of said guide tracks.

4. The furnace as set forth in claim 1, further comprising a plurality of baskets, pallet-like supports, each of said baskets is secured to one of said pallet-like supports, said tipping means includes lateral guide rails, and said supports are insertable in said lateral guide rails.

5. The furnace as set forth in claim 1, further comprising door means for isolating said discharging station from said furnace chamber.

6. The furnace as set forth in claim 1, wherein said glide tracks have ends, said reversing means comprise two piston-cylinder units arranged at the ends of said guide tracks, said piston-cylinder units have stroke directions running perpendicularly to the glide tracks and a direction of movement of the baskets thereon, said piston-cylinder units are adapted to be controlled selectively in dependency on the cycle succession of empty baskets leaving said discharging station.

7. The furnace as set forth in claim 1, further comprising feeding means aligned with said two track means adjacent said loading station for pushing filled baskets therealong toward said discharging station intermittently.

8. The furnace as set forth in claim 7, further comprising pulling and pushing means adjacent said discharging station for moving a filled basket into said discharging station and for pushing and emptied basket to said another track means and pushing the emptied baskets on said another track means toward said loading station.

* * * * *